United States Patent [19]

Richardson

[11] 4,045,899

[45] Sept. 6, 1977

[54] INDICATOR DEVICE FOR A GARMENT HANGER

[75] Inventor: William H. Richardson, Oklahoma City, Okla.

[73] Assignee: City Products Corporation, Chicago, Ill.

[21] Appl. No.: 658,595

[22] Filed: Feb. 17, 1976

[51] Int. Cl.[2] ..... G09F 3/00; G09F 3/04

[52] U.S. Cl. ..... 40/322; 116/114 R

[58] Field of Search ..... 40/322, 2 R, 19.5, 11 R, 40/316, 68; 116/114 R; 35/31 A, 31 B; D6/267; D19/19

[56] References Cited

U.S. PATENT DOCUMENTS

| | | | |
|---|---|---|---|
| 1,575,775 | 3/1926 | Lesser | 40/322 |
| 2,690,863 | 10/1954 | Adelman | 40/322 |
| 3,301,447 | 1/1967 | Felton | D6/257 |
| 3,535,808 | 10/1970 | Morrish | 40/322 |
| D. 192,845 | 5/1962 | Cohen | 40/322 |

FOREIGN PATENT DOCUMENTS

| | | | |
|---|---|---|---|
| 1,397,413 | 6/1975 | United Kingdom | 40/322 |

*Primary Examiner*—S. Clement Swisher
*Assistant Examiner*—Denis E. Corr
*Attorney, Agent, or Firm*—Allegretti, Newitt, Witcoff & McAndrews

[57] ABSTRACT

A size indicator or identifier for a garment hanger is disclosed. The size indicator includes a disc section and sidewall section which carries the size indicia. The disc section defines flexing means to securingly receive the garment hanger.

11 Claims, 3 Drawing Figures

Fig. 1
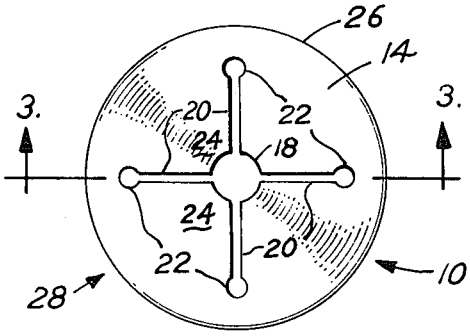
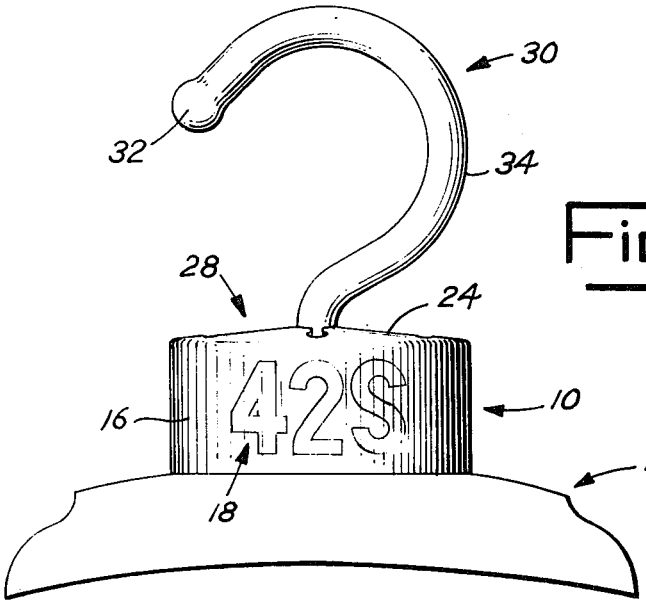
Fig. 2
Fig. 3
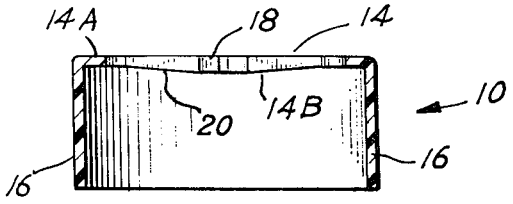

INDICATOR DEVICE FOR A GARMENT HANGER

BACKGROUND OF THE INVENTION

The present invention relates generally to an indicator or identification device and more particularly to a device for identifying the size of a garment on a garment hanger.

In clothing stores and warehouses, garments, such as suits and dresses, are hung upon hangers. The size of the garment is usually indicated on a tag or label attached to the garment itself. Often the tags are not readily visible, requiring a potential purchaser to handle the garment in order to determine its size.

This procedure is time consuming and often inconvenient. Further, the handling soils and wears the garment immediately adjacent the tag or label.

SUMMARY OF THE INVENTION

In a principal aspect, the present invention is an indicator device for a garment hanger. The present invention includes a disc section and sidewall section. An indicia is secured to the sidewall section.

The disc section includes a central aperture and at least a pair of slots extending therefrom. The slots terminate within the disc section, i.e., prior to the edge thereof. The disc section if flexible, and the central aperture, slots and flexibility of the disc section cooperatively define means for flexing the disc section to receive the garment hanger. As such, the present invention is adapted for use with garment hangers of any type or style.

It is thus an object of the present invention to provide an indicator device for a hanger. It is also an object of the present invention to provide a size indicator for a garment hanger.

Another object of the present invention is to provide a size indicator with substantially universal application. It is a further object of the present invention to provide a size indicator for a garment hanger, which is readily and inexpensively manufactured.

These and other objects, advantages and features of the present invention are apparent in the following detailed description.

BRIEF DESCRIPTION OF THE DRAWING

A preferred embodiment of the present invention will be described, in detail, with reference to the drawing wherein:

FIG. 1 is a top view of a preferred embodiment of the present invention;

FIG. 2 is a side view of the preferred embodiment of FIG. 1 shown in conjunction with a garment hanger; and FIG. 3 is a cross-sectional view of the preferred embodiment of FIG. 1 taken along 3—3.

DESCRIPTION OF THE PREFERRED EMBODIMENT

Referring to FIGS. 1-3, a preferred embodiment of the present invention is shown as a size indicator 10 for a garment hanger 12. The size indicator 10 includes a disc section 14, sidewall section 16 and size indicia 18.

As shown in FIGS. 1 and 3, the disc section 14 of the indicator 10 is substantially circular. The disc section 14 is flexible and preferably a plastic, such as polyethylene.

The disc section 14 includes a central, substantially circular aperture 18 and a series of slots 20 extending substantially radially from the central aperture 18. The slots 20 terminate within the disc section 14 in a series of openings 22. The openings 22 are smaller, in diameter, than the central aperture 18.

As shown, the slots 20 and respective openings 22 are equally angularly displaced and defined interposing disc portions 24. In this preferred embodiment, the disc section 14 includes four slots in a 90° arrangement, thereby defining four substantially triangular disc portions 24.

Referring now to FIG. 3, the disc portions 24 have a tapered cross section. More particularly, the top surface 14A of the disc section 14 is substantially planar, and the bottom surface 14B inclines from the central aperture 18 to the edge 26, such that the disc section 14 is substantially cone-shaped. For clarity, the taper has been exaggerated in FIG. 3. The taper of the disc portions 24 increases the flexibility of the disc section 14, as does the openings 22.

The sidewall section 16 is a peripheral flange, which extends substantially perpendicular to the disc portion 15 about the edge 26 thereof. In this preferred embodiment, the disc section 14 and sidewall section 16 are integral, and the size indicator 10 is injection molded.

The size indicia 18 is secured to the exterior wall of the sidewall section 16. Preferably, the indicia 18 is contrastingly colored and repetitively embossed or hot stamped on the sidewall section 16 at substantially equal intervals thereabout.

The flexibility, central aperture 18 and slots 20 of the disc section 14 cooperatively define means, generally designated 28, for flexing the disc section 14 to securingly receive the garment hanger 12 in an assembled state. Referring to FIG. 2, the garment hanger 12 includes a hook 30 having a nub 32 and shaft 34. Through the flexing means 28, the disc section 14 of the indicator 10 is flexed to provide sufficient access therethrough for the nub 32.

Depending upon the size of the central aperture 18 and the cross sectional area of the hanger shaft 30, the disc section 14, once in place on the hanger 12, returns to a relaxed or semi-relaxed state. The semi-relaxed state is shown in FIG. 2.

As shown, the disc portions 24 remain flexed and securingly engage the shaft 34 of the garment hanger 12 to positionally maintain the indicator 10. In this position, at the base of the hook 30, the size indicia 18 is readily visible and readable. Repeated about the sidewall section 16, the size indicia 18 is visible regardless of orientation.

A single preferred embodiment of the present invention has been disclosed herein. It is to understood, however, that various changes and modifications can be made without departing from the true scope and spirit of the present invention as defined in the following claims. For example, the size indicia 18 may be replaced by other indicia, such as the maker or price of the garment or an index as used in laundries and cloakrooms.

What is claimed is:

1. An indicator device for use in conjunction with a garment hanger having a hook comprising, in combination:

a flexible disc section having an edge, a central aperture therethrough and at least a pair of slots extending substantially radially from said central aperture, said slots terminating prior to said edge, said flexibility, central aperture and slots cooperatively defining means for flexing said disc section to receive said hook in an assembled state;

a sidewall section extending from said edge of said disc section; and an indicia secured to said sidewall section;

said slots defining at least two disc portions, said disc portions securingly engaging said hook in said assembled state, whereby said indicator device is substantially positionally maintained on said garment hanger;

said disc portions being tapered to increase the flexibility of said disc section.

2. An indicator device as claimed in claim 1 wherein said disc section and said sidewall section are integral.

3. An indicator device as claimed in claim 1 wherein said indicia is embossed upon said sidewall section.

4. An indicator device as claimed in claim 1 wherein said disc section is substantially planar.

5. An indicator device as claimed in claim 4 wherein said sidewall section extends substantially perpendicular to said planar disc section.

6. An indicator device as claimed in claim 1 wherein said slots terminate in openings near said edge.

7. An indicator device for use in conjunction with a garment hanger having a hook comprising, in combination:

a flexible, substantially circular disc section having an edge, a central aperture therethrough, at least a pair of opposed, substantially circular openings near said edge, and at least a pair of slots extending substantially radially from said central aperture to said opposed, substantially circular openings to define at least a pair of disc portions, said opposed, substantially circular openings being smaller than said central aperture, said disc portions cross-sectionally tapering from said central aperture towards said edge, said flexibility, central aperture, opposed, substantially circular openings, slots and taper of said disc portions cooperatively defining means for flexing said flexible, substantially circular disc section to receive and securingly engage said hook, whereby said indicator device is substantially positionally maintained on said garment hanger;

a sidewall section extending from said edge of said flexible, substantially circular disc section; and an indicia secured to said sidewall section.

8. An indicator device as claimed in claim 7 wherein said flexible, substantially circular disc section and said sidewall section are integral.

9. An indicator device as claimed in claim 8 wherein said indicia is embossed upon said sidewall section.

10. An indicator device as claimed in claim 8 wherein said sidewall section extends substantially perpendicular to said flexible, substantially circular disc section.

11. An indicator device as claimed in claim 7 including two pair of opposed, substantially circular openings and two pair of slots defining two pair of disc sections, said slots being substantially equally angularly displaced.

* * * * *